US006416699B1

(12) United States Patent
Gownder et al.

(10) Patent No.: US 6,416,699 B1
(45) Date of Patent: Jul. 9, 2002

(54) REDUCED SHRINKAGE IN METALLOCENE ISOTACTIC POLYPROPYLENE FIBERS

(75) Inventors: Mohan Gownder, Odessa; Jay Nguyen, Pasadena, both of TX (US)

(73) Assignee: Fina Technology, Inc., Houston, TX (US)

( * ) Notice: Subject to any disclaimer, the term of this patent is extended or adjusted under 35 U.S.C. 154(b) by 0 days.

(21) Appl. No.: 09/328,924

(22) Filed: Jun. 9, 1999

(51) Int. Cl.[7] ..... D01D 5/16; D01F 6/06
(52) U.S. Cl. ..... 264/210.8
(58) Field of Search ..... 264/210.8

(56) References Cited

U.S. PATENT DOCUMENTS

| | | | | |
|---|---|---|---|---|
| 4,298,718 | A | 11/1981 | Mayr et al. | |
| 4,544,717 | A | 10/1985 | Mayr et al. | |
| 4,560,734 | A | 12/1985 | Fujishita | |
| 4,692,380 | A | 9/1987 | Reid | |
| 4,701,432 | A | 10/1987 | Welborn, Jr. | |
| 4,794,096 | A | 12/1988 | Ewen | |
| 4,808,561 | A | 2/1989 | Welborn, Jr. | |
| 4,892,851 | A | 1/1990 | Ewen | |
| 4,975,403 | A | 12/1990 | Ewen | |
| 5,243,002 | A | 9/1993 | Razavi | |
| 5,272,003 | A | 12/1993 | Peacock | |
| 5,308,811 | A | 5/1994 | Suga et al. | |
| 5,318,735 | A | 6/1994 | Kozulla | |
| 5,444,134 | A | 8/1995 | Matsumoto | |
| 6,090,872 | A * | 7/2000 | Albe et al. | 524/111 |

FOREIGN PATENT DOCUMENTS

| | | |
|---|---|---|
| CN | 2178104 | 12/1996 |
| EP | 0600461 | 6/1994 |
| EP | 0905290 | 3/1999 |
| WO | 94/28219 | 12/1994 |

OTHER PUBLICATIONS

US 5,242,876, 09/1993, Shamshoum et al. (withdrawn)

* cited by examiner

*Primary Examiner*—Leo B. Tentoni
(74) *Attorney, Agent, or Firm*—William D. Jackson

(57) ABSTRACT

The present invention relates to a method for the production of polypropylene fibers resulting in improved shrinkage percentages and to polypropylene fibers themselves having improved shrinkage percentages. The method includes providing a polypropylene polymer with a melt flow index of no more than about 25 grams per 10 minutes. This polymer should include isotactic polypropylene produced by the polymerization of propylene in the presence of an isospecific metallocene catalyst. The polymer is then heated to a molten state and extruded to form a fiber preform. The preform is spun and subsequently drawn at a take-away speed and a drawing speed providing a draw ratio of no more than about 3, and more preferably no more than about 2.5, to produce a continuous polypropylene fiber. The fiber based on metallocene catalyzed isotactic polypropylene demonstrates improved shrinkage properties of at least about 10% and at some draw ratios at least about 25% over the shrinkage properties of Ziegler-Natta catalyzed isotactic polypropylenes having similar melt-flow indices. In the same method, when the polymer is heated to a molten state, the polymer is preferably heated in a feeding zone to a temperature within the range of about 180° C. to about 225° C. followed by heating in an extrusion zone to a temperature within the range of about 215° C. to about 240° C. immediately prior to extruding the polymer.

15 Claims, 5 Drawing Sheets

REDUCED SHRINKAGE IN METALLOCENE ISOTACTIC POLYPROPYLENE FIBERS

FIELD OF THE INVENTION

This invention relates to polypropylene fibers and, more particularly, to such fibers and processes for their preparation from metallocene-based isotactic polypropylene.

BACKGROUND OF THE INVENTION

Isotactic polypropylene is one of a number of crystalline polymers which can be characterized in terms of the stereoregularity of the polymer chain. Various stereospecific structural relationships, characterized primarily in terms of syndiotacticity and isotacticity, may be involved in the formation of stereoregular polymers for various monomers. Stereospecific propagation may be applied in the polymerization of ethylenically-unsaturated monomers, such as $C_3$+alpha olefins, 1-dienes such as 1,3-butadiene, substituted vinyl compounds such as vinyl aromatics, e.g. styrene or vinyl chloride, vinyl chloride, vinyl ethers such as alkyl vinyl ethers, e.g, isobutyl vinyl ether, or even aryl vinyl ethers. Stereospecific polymer propagation is probably of most significance in the production of polypropylene of isotactic or syndiotactic structure.

Isotactic polypropylene is conventionally used in the production of fibers in which the polypropylene is heated and then extruded through one or more dies to produce a fiber preform which is processed by a spinning and drawing operation to produce the desired fiber product. The structure of isotactic polypropylene is characterized in terms of the methyl group attached to the tertiary carbon atoms of the successive propylene monomer units lying on the same side of the main chain of the polymer. That is, the methyl groups are characterized as being all above or below the polymer chain. Isotactic polypropylene can be illustrated by the following chemical formula:

(1)

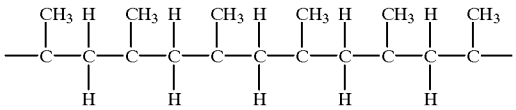

Stereoregular polymers, such as isotactic and syndiotactic polypropylene, can be characterized in terms of the Fisher projection formula. Using the Fisher projection formula, the stereochemical sequence of isotactic polypropylene, as shown by Formula (2), is described as follows:

(2)

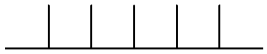

Another way of describing the structure is through the use of NMR. Bovey's NMR nomenclature for an isotactic pentad is . . . mmmm . . . with each "m" representing a "meso" dyad, or successive methyl groups on the same side of the plane of the polymer chain. As is known in the art, any deviation or inversion in the structure of the chain lowers the degree of isotacticity and crystallinity of the polymer.

In contrast to the isotactic structure, syndiotactic propylene polymers are those in which the methyl groups attached to the tertiary carbon atoms of successive monomeric units in the polymer chain lie on alternate sides of the plane of the polymer. Using the Fisher projection formula, the structure of syndiotactic polypropylene can be shown as follows:

(3)

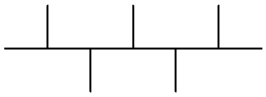

The corresponding syndiotactic pentad is rm with each r representing a racemic diad. Syndiotactic polymers are semi-crystalline and, like the isotactic polymers, are insoluble in xylene. This crystallinity distinguishes both syndiotactic and isotactic polymers from an atactic polymer, which is non-crystalline and highly soluble in xylene. An atactic polymer exhibits no regular order of repeating unit configurations in the polymer chain and forms essentially a waxy product. Catalysts that produce syndiotactic polypropylene are disclosed in U.S. Pat. No. 4,892,851. As disclosed there, the syndiospecific metallocene catalysts are characterized as bridged structures in which one Cp group is sterically different from the others. Specifically disclosed in the '851 patent as a syndiospecific metallocene is isopropylidene(cyclopentadienyl-1-fluorenyl) zirconium dichloride.

In most cases, the preferred polymer configuration will be a predominantly isotactic or syndiotactic polymer with very little atactic polymer. Catalysts that produce isotactic polyolefins are disclosed in U.S. Pat. Nos. 4,794,096 and 4,975,403. These patents disclose chiral, stereorigid metallocene catalysts that polymerize olefins to form isotactic polymers and are especially useful in the polymerization of highly isotactic polypropylene. As disclosed, for example, in the aforementioned U.S. Pat. No. 4,794,096, stereorigidity in a metallocene ligand is imparted by means of a structural bridge extending between cyclopentadienyl groups. Specifically disclosed in this patent are stereoregular hafnium metallocenes which may be characterized by the following formula:

$$R''(C_5(R')_4)_2HfQp \quad (4)$$

In Formula (4), $(C_5\ (R')4)$ is a cyclopentadienyl or substituted cyclopentadienyl group, R' is independently hydrogen or a hydrocarbyl radical having 1–20 carbon atoms, and R" is a structural bridge extending between the cyclopentadienyl rings. Q is a halogen or a hydrocarbon radical, such as an alkyl, aryl, alkenyl, alkylaryl, or arylalkyl, having 1–20 carbon atoms and p is 2.

Metallocene catalysts, such as those described above, can be used either as so-called "neutral metallocenes" in which case an alumoxane, such as methylalumoxane, is used as a co-catalyst, or they can be employed as so-called "cationic metallocenes" which incorporate a stable non-coordinating anion and normally do not require the use of an alumoxane. For example, syndiospecific cationic metallocenes are disclosed in U.S. Pat. No. 5,243,002 to Razavi. As disclosed there, the metallocene cation is characterized by the cationic metallocene ligand having sterically dissimilar ring structures which are joined to a positively-charged coordinating transition metal atom. The metallocene cation is associated with a stable non-coordinating counter-anion. Similar relationships can be established for isospecific metallocenes.

Catalysts employed in the polymerization of alpha-olefins may be characterized as supported catalysts or as unsupported catalysts, sometimes referred to as homogeneous catalysts. Metallocene catalysts are often employed as unsupported or homogeneous catalysts, although, as described below, they also may be employed in supported catalyst components. Traditional supported catalysts are the so-called "conventional" Ziegler-Natta catalysts, such as titanium tetrachloride supported on an active magnesium dichloride, as disclosed, for example, in U.S. Pat. Nos. 4,298,718 and 4,544,717, both to Myer et al. A supported catalyst component, as disclosed in the Myer '718 patent, includes titanium tetrachloride supported on an "active" anhydrous magnesium dihalide, such as magnesium dichloride or magnesium dibromide. The supported catalyst component in Myer '718 is employed in conjunction with a co-catalyst such and an alkylaluminum compound, for example, triethylaluminum (TEAL). The Myer '717 patent discloses a similar compound which may also incorporate an electron donor compound which may take the form of various amines, phosphenes, esters, aldehydes, and alcohols.

While metallocene catalysts are generally proposed for use as homogeneous catalysts, it is also known in the art to provide supported metallocene catalysts. As disclosed in U.S. Pat. Nos. 4,701,432 and 4,808,561, both to Welborn, a metallocene catalyst component may be employed in the form of a supported catalyst. As described in the Welborn '432 patent, the support may be any support such as talc, an inorganic oxide, or a resinous support material such as a polyolefin. Specific inorganic oxides include silica and alumina, used alone or in combination with other inorganic oxides such as magnesia, zirconia and the like. Non-metallocene transition metal compounds, such as titanium tetrachloride, are also incorporated into the supported catalyst component. The Welborn '561 patent discloses a heterogeneous catalyst which is formed by the reaction of a metallocene and an alumoxane in combination with the support material. A catalyst system embodying both a homogeneous metallocene component and a heterogeneous component, which may be a "conventional" supported Ziegler-Natta catalyst, e.g. a supported titanium tetrachloride, is disclosed in U.S. Pat. No. 5,242,876 to Shamshoum et al. Various other catalyst systems involving supported metallocene catalysts are disclosed in U.S. Pat. Nos. 5,308,811 to Suga et al and 5,444,134 to Matsumoto.

The polymers normally employed in the preparation of drawn polypropylene fibers are normally prepared through the use of conventional Ziegler-Natta catalysts of the type disclosed, for example, in the aforementioned patents to Myer et al. U.S. Pat. Nos. 4,560,734 to Fujishita and 5,318,734 to Kozulla disclose the formation of fibers by heating, extruding, melt spinning, and drawing from polypropylene produced by titanium tetrachloride-based isotactic polypropylene. Particularly, as disclosed in the patent to Kozulla, the preferred isotactic polypropylene for use in forming such fibers has a relatively broad molecular weight distribution (abbreviated MWD), as detenriined by the ratio of the weight average molecular weight ($M_w$) to the number average molecular ($M_n$) of about 5.5 or above. Preferably, as disclosed in the Kozulla patent, the molecular weight distribution, $M_w/M_n$, is at least 7.

SUMMARY OF THE INVENTION

The present invention relates to a method for the production of polypropylene fibers. The method includes providing a polypropylene polymer with a melt flow index of no more than about 25 grams per 10 minutes. This polymer includes isotactic polypropylene produced by the polymerization of propylene in the presence of an isospecific metallocene catalyst. The polymer is then heated to a molten state and extruded to form a fiber preform. The preform is spun and subsequently drawn at a take-away speed and a drawing speed providing a draw ratio of no more than about 3, and more preferably no more than about 2.5, to produce a continuous polypropylene fiber. The fiber based on metallocene catalyzed isotactic polypropylene demonstrates improved shrinkage properties of at least about 10% and at some draw ratios at least about 25% over the shrinkage properties of Ziegler-Natta catalyzed isotactic polypropylenes having similar melt-flow indices. In the same method, when the polymer is heated to a molten state, the polymer is preferably heated in a feeding zone to a temperature within the range of about 180° C. to about 225° C. followed by heating in an extrusion zone to a temperature within the range of about 215° C. to about 240° C. Immediately prior to extruding the polymer.

The present invention further encompasses an elongated fiber product comprising a drawn polypropylene fiber. The fiber is prepared from an isotactic polypropylene having a melt flow index within the range of about 5 grams per 10 minutes to about 15 grams per 10 minutes, polymerized in the presence of an isospecific metallocene catalyst. The fiber is spun and drawn with a draw ratio within the range of about 1.5 to about 4 at a draw speed of at least about 1,000. The fiber has a percentage shrinkage at 132° C. within the range of about 8% to about 12%.

The present invention further encompasses an elongated fiber product comprising a drawn polypropylene fiber prepared from an isotactic polypropylene having a melt flow index within the range of about 15 grams per 10 minutes to about 25 grams per 10 minutes, polymerized in the presence of an isospecific metallocene catalyst. The fiber is spun and drawn with a draw ratio within the range of about 1.5 to about 4 at a draw speed of at least about 1,000. The fiber has a percentage shrinkage at 132° C. within the range of about 6% to about 10%.

DETAILED DESCRIPTION OF THE INVENTION

The fiber products of the present invention are formed using a particularly-configured polyolefin polymer, as described in greater detail below, and by using any suitable melt spinning procedure, such as the Fourne fiber spinning line. The use of isospecific metallocene catalysts in accordance with the present invention provides for isotactic polypropylene structures which can be correlated with desired fiber characteristics, such as strength, toughness, shrinkage, and in terms of the draw speed and draw ratios employed during the fiber-forming procedure.

Figure 1:
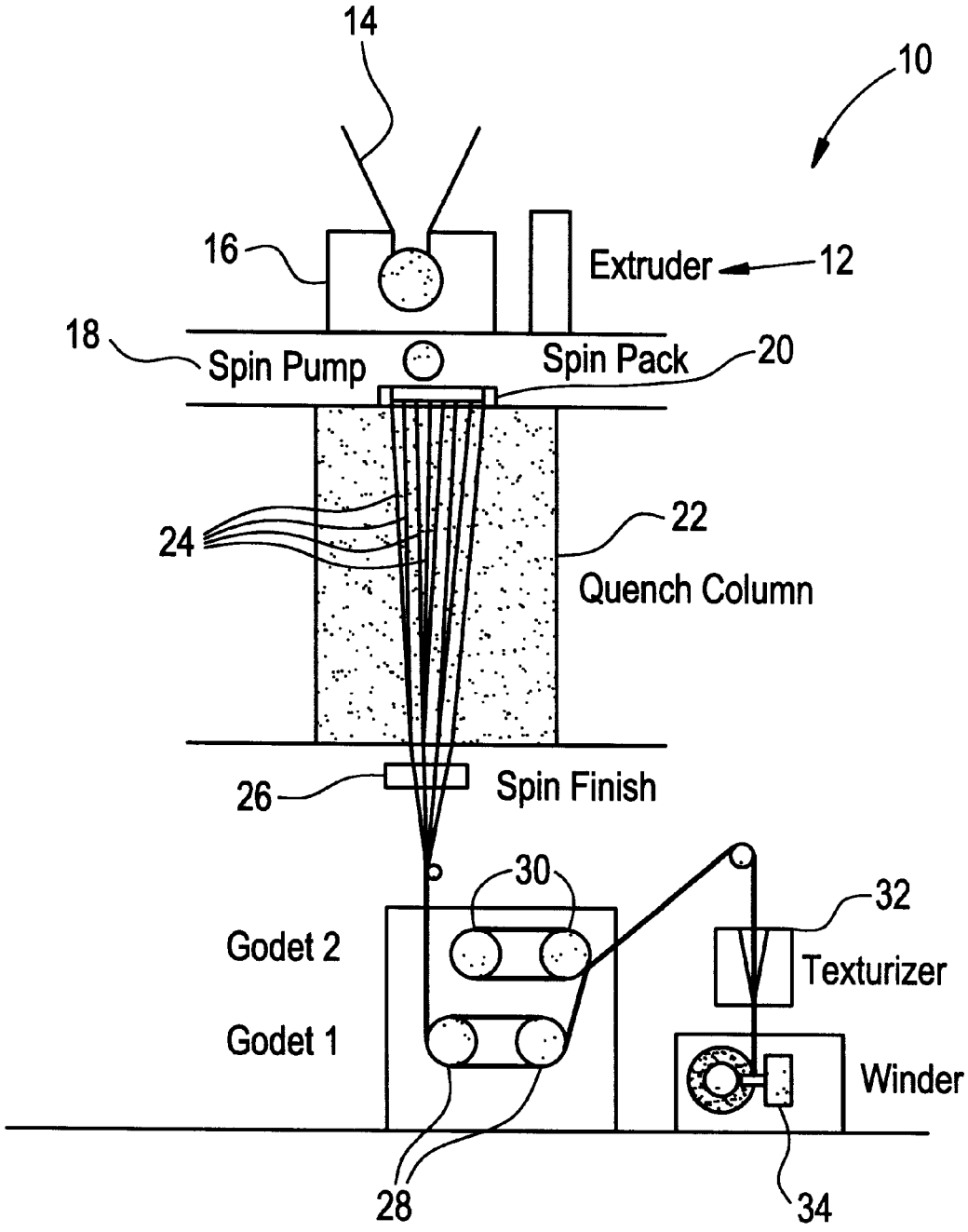
FIG. 1 is a schematic representation of an exemplary Fourne fiber spinning and drawing line.

The fibers produced in accordance with the present invention can be formed by any suitable melt spinning procedure, such as the Fourne melt spinning procedure, as will be understood by those skilled in the art. In using a Fourne fiber spinning machine 10 such as illustrated in FIG. 1, the polypropylene is passed from a hopper 14 through a heat exchanger 16 where the polymer pellets are heated to a suitable temperature for extrusion, about 180–280° C. for the metallocene-based polypropylene used here, and then through a metering pump 18 (also called a spin pump) to a spin extruder 20 (also called a spin pack). The portion of the machine from hopper 14 through the spin pack 20 is collectively referred to as extruder 12. The fiber preforms 24 thus formed are cooled in air in quench column 22 then passed through a spin finisher 26. The collected fibers are then applied through one or more godets to a take-away roll, illustrated in this embodiment as rolls 28 (also collectively referred to as Godet 1. These rolls are operated at a desired take-away rate (referred to as the G1 speed), about 100–1500 meters per minute, in the present invention. The thus-formed filaments are drawn off the spin role to the drawing rollers 30 (also collectively referred to as Godet 2) which are operated at a substantially-enhanced speed (the draw speed or G2 speed) in order to produce the drawn fiber. The draw speed normally will range from about 500–4,000 meters per minute and is operated relative to the take-away godet to provide the desired draw ratio normally within the range of 1.5:1 to 6:1. The spun and drawn fiber is often passed through a texturizer 32 and then wound up on a winder 34. While the illustrated embodiment and description encompasses the spinning and drawing of a fully oriented yarn, the same equipment may also be used to make a partially oriented yarn. In that instance the drawing step is left out leaving only the act of spinning the yarn out of the extruder. This step is often accomplished by connecting winder 34 immediately following spin finisher 26, and certainly involves bypassing drawing rollers 30. The force of winding/spinning the yarn off of the extruder does result in some stress and elongation, partially orienting the yarn, but does not provide the full benefits of a complete drawing process. For a further description of suitable fiber-spinning procedures for use in the present invention, reference is made to the aforementioned U.S. Pat. Nos. 5,272,003 and 5,318,734, the entire disclosures of which are incorporated herein by reference.

The process of melt spinning of polypropylene can be termed as non-isothermal crystallization under elongation. The rate of crystallization in this process is highly influenced by the speed of take-away. In the commercial production of bulk continuous filament (BCF) fibers, there is an integrated two-step process involving the initial spinning (or take-away) step and the subsequent drawing step. This gives the fibers the required mechanical properties such as tenacity and elongation. In the past, attempts have been made to eliminate this integrated two-step process and substitute it with a single-step high speed spinning. It was expected that the high speed spinning would incorporate enough orientation in the fiber to give a high tenacity and modulus. This expectation was not met as disclosed in Ziabicki, "Development of Polymer Structure in High speed Spinning," Proceedings of the International Symposium on Fiber Science and Technology, ISF-85, I-4, 1985. As discussed there, in studying PET fibers, this is mainly due to the high-speed spun fibers exhibiting a high degree of crystallinity and crystal orientation rather than amorphous orientation. The high entanglement in the amorphous orientation prevents sliding of the long molecules when strained giving the fiber a high tenacity.

The present invention involves the use of isotactic polypropylene polymerized in the presence of metallocene catalysts to make fibers, both partially and fully oriented fibers with improved shrinkage characteristics. While applicable in most propylene fibers where the use of isotactic polypropylene is desired, the present description focuses on use in fully-oriented fiber processes such as the Fourne process. It is to be recognized that the invention may be applied to oriented fibers in general in addition to the specific application details of the Fourne process which may impose more rigorous concerns with respect to fiber breakage and/or orientation.

Oriented fibers are characterized in terms of certain well-defined characteristics relating to their stereoregular structures and physical properties, including melt temperatures and shrinkage characteristics, as well as in relatively low coefficients of friction and relatively high tensile moduli. The present invention addresses fibers involving the use of isotactic polypropylene as a homopolymer. The present invention also involves the use isotactic polypropylene as a primary component either in an ethylene-propylene copolymer or in combination with atactic or syndiotactic polypropylene homopolymer.

The polymerized mixture will often further include minor amounts (typically less than 1 weight percent, and more typically less than 0.5 weight percent) of additives designed to enhance other physical or optical properties. Such mixtures may have, for example, one or more anti-oxidants present in an amount totaling no more than about 0.25 weight percent (in the tested examples no more than about 0.15 weight percent) and one or more acid neutralizers present in an amount totaling no more than about 0.25 weight percent (in the tested examples no more than about 0.05 weight percent). Although not present in the tested examples, additives acting as "anti-block" agents may also be present, again in relatively low percentages such as no more than about 1 weight percent, more preferably no more than about 0.5 weight percent, and even more preferably no more than about 0.25 weight percent.

As discussed, the present invention involves the use of a metallocene catalyst to polymerize propylene. This invention focuses on the use of stereospecific metallocene catalysts. Generally, as discussed above, metallocenes are characterized by the formula:

$$R''(C_5(R')_4)_2MeQp \quad (4)$$

"Me" is the designation used for the generic transition metal which defines the metallocene catalyst, where Me is a Group 4, 5, or 6 metal from the Periodic Table of Elements but preferably is a Group 4 or 5 metal and more preferably a Group 4 metal, specifically titanium, zirconium, or hafnium. Vanadium is the most suitable of the Group 5 metals. For the present invention, Me is most preferably zirconium.

Various possible structures R" are also possible for the structural bridge. R" is a stable component that bridges the two $(C_5(R')_4)$ rings in order to render the catalyst stereorigid. R" may be organic or inorganic and may include groups depending from the moiety acting as a bridge. Examples of R" include an alkylene radical having 1–4 carbon atoms, a silicon hydrocarbyl group, a germanium hydrocarbyl group, an alkyl phosphine, an alkyl amine, boron, nitrogen, sulfur, hosphorous, aluminum or groups containing these elements. The preferred R" components are methylene, ethylene, substituted methylene such as isopropylidene and diphenyl methylene, and alkyl silicon, and cycloalkyl silicon moieties such as dicyclopropyl silyl, among others. For the present invention, a silicon bridge is most preferable, particularly a dimethylsilyl bridge.

As noted previously, a preferred practice in forming polypropylene fibers has been to produce the fibers from stereoregular isotactic polypropylene produced by supported Ziegler-Natta catalysts, that is, catalysts such as zirconium or titanium tetrachloride supported on crystalline supports such as magnesium dichloride.

Canadian Patent Application No. 2,178,104 discloses propylene polymers prepared in the presence of isospecific catalysts incorporating heavily substituted bis(indenyl) ligand structures and the use of such polymers in forming biaxially-oriented polypropylene films. As described in the Canadian application, the polymers used have a very narrow molecular weight distribution, preferably less than three, and well-defined uniform melting points. In each case the ligand structures are substituted on both the cyclopentyl portion of the indenyl structure (at the 2 position), and also on the aromatic portion of the indenyl structure. The tri-substituted structures appear to be preferred, and less relatively-bulky substituents are used in the case of 2-methyl, 4-phenyl substituted ligands or the 2-ethyl, 4phenyl substituted ligands.

The present invention can be carried out with isotactic polypropylene prepared in the presence of metallocenes, as disclosed in the Canadian Peiffer patent application. Alternatively, the present invention may be carried out by employing a polypropylene produced by an isospecific metallocene based upon an indenyl structure which is mono-substituted at the proximal position and otherwise unsubstituted, with the exception that the indenyl group can be hydrogenated at the 4, 5, 6, and 7 positions. Thus, the ligand structure may be characterized by racemic silyl-bridged bis(2-alkylindenyl) or a 2-alkyl hydrogenated indenyl as indicated by the following structural formulas.

(6)

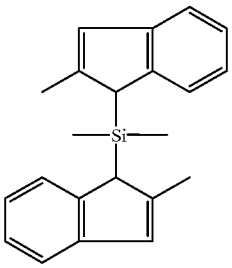

(7)

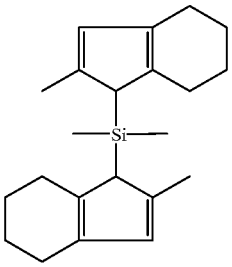

A specific example is a rac dimethyl silyl bis(2 methyl indenyl ligand structure).

Mixtures of mono- and poly-substituted indenyl-based metallocenes may be used in producing the polymers used in the present invention. Poly-substituted indenyl-based metallocenes may be employed in conjunction with the mono-substituted indenyl structures shown above. In this case, at least 10% of the metallocene catalyst system should comprise the mono-substituted bis(indenyl) structure. Preferably, at least 25% of the catalyst system comprises the mono-substituted bis(indenyl) metallocene. The remainder of the catalyst system can include polysubstituted indenyl-based metallocenes.

The metallocene or metallocene mixture catalyst systems employed in the present invention are used in combination with an alumoxane co-catalyst as will be well understood by those skilled in the art. Normally, methylalumoxane will be employed as a co-catalyst, but various other polymeric alumoxanes, such as ethylalumoxane and isobutylalumoxane, may be employed in lieu of or in conjunction with methylalumoxane. The use of such co-catalysts in metallocene-based catalyst systems are well-known in the art, as disclosed, for example, in U.S. Pat. No. 4,975,403, the entire disclosure of which is incorporated herein by reference. So-called alkylaluminum co-catalysts or scavengers are also normally employed in combination with the metallocene alumoxane catalyst systems. Suitable alkylaluminum or allylaluminum halides include trimethyl aluminum, triethylaluminum (TEAL), triisobutylaluminum (TIBAL), and tri-n-octylaluminum (TNOAL). Mixtures of such co-catalysts may also be employed in carrying out the present invention. While trialkylaluminums will usually be used as scavengers, it is to be recognized that alkylaluminum halides, such as diethylaluminum chloride, diethylaluminum bromide, and dimethylaluminum chloride, or dimethylaluminum bromide, may also be used in the practice of the present invention.

While the metallocene catalysts employed in the present invention can be used as homogeneous catalyst systems, preferably they are used as supported catalysts. Supported catalyst systems are well-known in the art as both conventional Ziegler-Natta and metallocene-type catalysts. Suitable supports for use in supporting metallocene catalysts are disclosed, for example, in U.S. Pat. No. 4,701,432 to Welborn, and include talc, an inorganic oxide, or a resinous support material such as a polyolefin. Specific inorganic oxides include silica and alumina, used alone or in combination with other inorganic oxides such as magnesia, titania, zirconia, and the like. Other support for metallocene catalysts are disclosed in U.S. Pat. Nos. 5,308,811 to Suga et al and 5,444,134 to Matsumoto. In both patents the supports are characterized as various high surface area inorganic oxides or clay-like materials. In the patent to Suga et al, the support materials are characterized as clay minerals, ion-exchanged layered compounds, diatomaceous earth, silicates, or zeolites. As explained in Suga, the high surface area support materials should have volumes of pores having a radii of at least 20 angstroms. Specifically disclosed and preferred in Suga are clay and clay minerals such as montmorillonite. The catalyst components in Suga are prepared by mixing the support material, the metallocene, and an organoaluminum compound such as triethylaluminum, trimethylaluminum, various alkylaluminum chlorides, alkoxides, or hydrides or an alumoxane such as methylalumoxane, ethylalumoxane, or the like. The three components may be mixed together in any order, or they may be simultaneously contacted. The patent to Matsumoto similarly discloses a supported catalyst in which the support may be provided by inorganic oxide carriers such as $SiO_2$, $Al_2O_3$, MgO, $ZrO_2$, $TiO_2$, $Fe_2O_3$, $B_2O_2$, CaO, ZnO, BaO, $ThO_2$ thereof, such as silica alumina, zeolite, ferrite, and glass fibers. Other carriers include $MgCl_2$, $Mg(0\text{-}Et)_2$, and polymers such as polystyrene, polyethylene, polypropylene, substituted polystyrene and polyarylate, starches, and carbon. The carriers are described as having a surface area of 50–500 $m^2/g$ and a particle size of 20–100 microns. Supports such as those described above may be used. Preferred supports for use in carrying out the present invention include silica, having a surface area of about 300–800 $m^2/g$ and a particle size of about 5–10 microns. Where mixtures of metallocenes are employed in formulating the catalyst system, the support may be treated with an organoaluminum co-catalyst, such as TEAL or TIBAL, and then contacted with a hydrocarbon solution of the metallocenes followed by drying steps to remove the solvent to arrive at a dried particulate catalyst system. Alternatively, mixtures of separately supported metallocenes may be employed. Thus, where a mixture of metallocenes are employed, a first metallocene, such as racemic dimethylsilyl bis(2-methyl indenyl) zirconium dichloride, may be supported on a first silica support. The second di-substituted metallocene, such as racemic dimethylsilyl bis(2-methyl, 4-phenyl indenyl) zirconium dichloride, can be supported on a second support The two quantities of separately supported metallocenes may then be mixed together to form a heterogeneous catalyst mixture which is employed in the polymerization reaction.

From the foregoing description, it will be recognized that the fiber-forming operation can be modified in terms of the isotactic polypropylene and its polymerization catalyst and in terms of the fiber spinning parameters to produce fibers of desired physical characteristics during one mode of operation and of another desired physical characteristic or characteristics during another mode of operation. Parameters which can be varied include draw speed and spin speed over desired ranges while maintaining the draw ratio constant or varying the draw ratio in order to impact parameters such as percent elongation and toughness. Similarly, in the course of the fiber spinning operation, a change may be made from a polymer catalyzed by one catalyst system to a polymer catalyzed by a different catalyst system to impact such physical parameters of the fibers while maintaining the draw speed and/or the draw ratio constant or while varying these fiber spinning parameters. As indicated by the experimental data, the use of propylene polymers prepared with the metallocene catalysts is desirable in terms of producing good shrinkage properties at lower draw ratios (for example at draw ratios less than or equal to about 3.5 or more preferably less than or equal to about 3). These improvements over Ziegler-natta catalyzed polymers of similar melt-flow index are obtained without significant changes or losses in strength, elongation, or toughness in the resulting fibers.

In experimental work respecting the invention, two sets of three isotactic polypropylene polymers, each set having two polymers (also called resins) produced by metallocene catalysis and one polymer (or resin) by catalysis with a supported Ziegler-Natta catalyst subjected to high speed spinning and drawing, were studied to confirm the capability of the metallocene-based polymers to provide improved shrinkage properties at low to medium draw ratios without significant loss in other mechanical properties. During the fiber-forming operation, the polymer is fully amorphous in the melt state, partially oriented during the draw down state, and highly oriented during cold drawing. The two sets were grouped based on similar melt-flow indices. Specifically, the first set had relatively low melt-flow indices (14, 9, & 11 g/10 min), while the second set had medium melt-flow indices (20, 19, & 22 g/10 min). Additional testing done with high and very high melt-flow indices (above about 30 g/10 min) did not reveal the same significant advantages in shrinkage ratio between the isotactic propylenes polymerized in the presence of a metallocene catalyst and those polymerized in the presence of a more traditional Ziegler-Natta catalyst. The test results provide indication of significant advantages in shrinkage ratio for melt flow indices below about 30 g/10 min.

The melt spinning and drawing operations were carried out using a trilobal spinnerette with 60 holes (0.3/0.7 mm) producing Fully oriented Yarns (FOY) of 10 denier per fiber (dpf) and Partially Oriented Yams (POY) of 2 dpf. The fibers were spun at their optimum melt temperatures ranging between 200° C. to 230° C. The draw ratios for the FOY were increased in steps of 0.5 up to their maximum draw, with the final Godet Speed (G2, also referred to as the drawing speed) maintained at 1000 m/min. Samples of about 2400 denier were collected at each draw ratio for the properties testing. The spinning fiber was quenched at 2.0 mBar with cool air at 10° C. The godet temperatures were maintained at 120° C. for the spin godet (G1) and at 100° C. at the second godet (G2). The linear density desired was maintained by varying the spin pump speed and winder speed accordingly. In the experiments with FOY the draw speed (G2) was maintained at a constant 1000 m/min, with the spin speed (G1) gradually decreased to obtain the 0.5 step increases in draw ratio. Normal commercial operation has spin and draw speeds of about 500 m/min and 1500 m/min respectively to provide a draw ratio of 3:1. The limitations of the material would determine the extent to which the draw ratio can be increased. In the experimental work both the godets and the Barmag winder in the Fourne fiber line have a maximum speed of 6000 m/min.

The following examples illustrate the unexpected advantages in shrinkage provided by the present invention. The example also provides an illustration of the effects of the present invention on other physical and process properties.

EXAMPLE 1

In the first set of tests, several "low" melt-flow index homopolymer resins of isotactic polypropylene were used.

Two of the three resins were isotactic polypropylenes which had been generated by a supported metalocene catalyst, while the third resin was an isotactic polypropylene generated by a supported Ziegler-Natta catalyst. The two metallocene-based isotactic polypropylenes (Low MFI MIPP 1 (or "MIPP 1") and Low MFI MIPP 2 (or "MIPP 2")) and the Ziegler-Natta-based isotactic polypropylene (Low MFI ZNPP 1 (or "ZNPP 1")) were used to prepare melt spun yarns on a Fourne fiber spinning machine. Both partially oriented yarn (POY) and fully oriented yarn (FOY) were prepared.

With respect to the polymer resins used, MIPP 1 and MIPP 2 were each generated using a, metallocene catalyst, specifically a silyl bridged rac bis indenyl zirconium dichloride. MIPP 1 had a measured melt flow index of 14 grams per 10 minutes with xylene solubles of 0.4%. MIPP 1 also included the following additives (identified here by the tradenames under which they are commercially available): Irganox 1010 (an anti-oxidant) in an amount of 0.073 weight percent, Irganox 1076 (an anti-oxidant) in an amount of 0.005 weight percent, Irgafos 168 (an anti-oxidant) in an amount of 0.05 weight percent, and calcium stearate (an acid neutralizer) in an amount of 0.035 weight percent.

MIPP 2 as noted above was also generated using a metallocene catalyst, specifically ["FINA MIPP Broad MW"]. MIPP 2 had a measured melt flow index of 9 grams per 10 minutes with a xylene solubles percentage of 0.5%. MIPP 2 included the following additives (identified here by the tradenames under which they are commercially available): Irganox 1076 (an anti-oxidant) in an amount of 0.01 weight percent, Irgafos 168 (an anti-oxidant) in an amount of 0.0095 weight percent, Chimasorb 944 (a UV stabilizer) in an amount of 0.031 weight percent, aad calcium stearate (an acid neutralizer) in an amount of 0.047 weight percent.

The sample ZNPP 1 was polymerized using a standard Ziegler-Natta catalyst, more specifically a supported titanium tetrachloride catalyst of the type disclosed in the aforementioned Myer patents with a cyclohexyl methyl dimethoxysilane electron donor. ZNPP 1 had a measured melt flow index of 11 grams per 10 minutes with xylene solubles of 1.4%. ZNPP 1 included the following additives (identified here by the tradenames under which they are commercially available): Irganox 1076 (an anti-oxidant) in an amount of 0.005 weight percent, Ultranox 626 (an anti-oxidant) in an amount of 0.086 weight percent, Atmos 150 (an anti-static agent) in an amount of 0.033 weight percent, and calcium stearate (an acid neutralizer) in an amount of 0.066 weight percent.

It was generally observed that the metallocene polypropylenes of MIPP 1 and MIPP 2, with their narrow molecular weight distribution, have lower melting points than Ziegler-Natta polypropylenes of comparable melt flow index. Table 1 below shows that ZNPP 1, the Ziegler-Natta polypropylene, had a melting point of 162° C. which is at least 10° more than that of the MIPP 1 and MIPP 2 metallocene polymers which were 152° C. and 151° C., respectively. The metallocene isotactic polypropylene materials had a lower heat absorb for melting (endothennic) and a lower heat evolved during heat recrystallization (exothermic) demonstrating that they have a lower crystalline content than the Ziegler-Natta polypropylene ZNPP 1.

TABLE 1

| | Low MFI MIPP 1 | Low MFI MIPP 2 | Low MFI ZNPP 1 |
|---|---|---|---|
| DSC 2nd Melt (° C.) | 152 | 151 | 162 |
| dH, 2nd Melt (J/g) | 93 | 90 | 107 |
| DSC, Recryst (° C.) | 110 | 109 | 111 |
| dH, Recryst (J/g) | −93 | −91 | −104 |

Table 2 shows the gel permeation chromatography results. The metallocene compounds of MIPP 1 and MIPP 2 have a narrower molecular weight distribution, as shown by the lower polydispersity index (PDI).

TABLE 2

| | Low MFI MIPP 1 | Low MFI MIPP 2 | Low MFI ZNPP 1 |
|---|---|---|---|
| $M_n$ (g/mol) | 45,000 | 59,000 | 29,000 |
| $M_n$ (g/mol) | 182,000 | 225,000 | 239,000 |
| PDI | 4.1 | 3.8 | 8.3 |
| $M_z$ (g/mol) | 438,000 | 577,000 | 928,000 |

The actual processing of fully and partially oriented yarns from the base resins was accomplished on a Fourne fiber line as addressed above. The processing details are shown in Table 3 below. All three resins were processed at a melt temperature of 230° C. Pellet feeding problems were observed in the extruder for the two MIPP resins. Raising the temperature of the feeding zone to 200° C. alleviated the feeding problem. Ordinarily the feeding zone temperature is around 160° C. MIPP 1 showed higher spinnability (the 2 dpf POY filament broke at 4500 mlmin) and drawability (the 10 dpf FOY filament made it to a draw ratio of 4.5) compared to the other two resins. Though promising, the spin and draw tensions at draw ratio of 3:1 were considerably lower, which usually translates to a lower tenacity at this draw.

TABLE 3

| | Low MFI MIPP 1 | Low MFI MIPP 2 | Low MFI ZNPP 1 |
|---|---|---|---|
| MFI (g/10 min) | 14 | 9 | 11 |
| Melt Temperature (° C.) | 230 | 230 | 230 |
| Extruder Motor Load (Amp) | 9 | 9.8 | 9 |
| Extruder/Spin Pump speed to spin 2400 denier (rpm) | 94/32 | 94/32 | 100/32 |
| Spinnability @ 2 dpf (m/min) | 4500 | 2200 | 2700 |
| Spin Tension @ 3:1 draw and G2 = 1000 m/min (gf) | 44 | 60 | 67 |
| Draw Tension @ 3:1 draw and G2 = 1000 m/min (gf) | 1320 | 1800 | 2540 |
| Drawability @ G2 = 1000 m/min | 4.5 | 4.0 | 4.0 |

Figure 2:
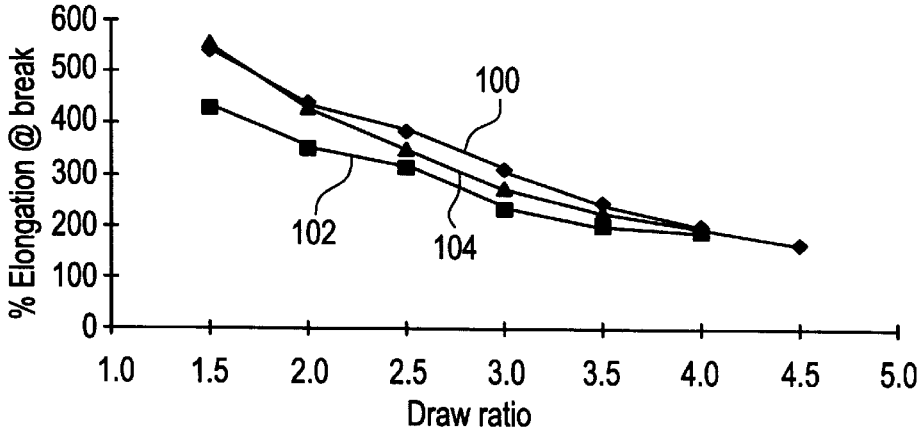
FIG. 2 is a graph of elongation on the ordinate versus draw ratio on the abscissa for low melt flow index polypropylene prepared by catalysis with metallocene catalyst and a Ziegler-Natta catalyst.
Figure 3:
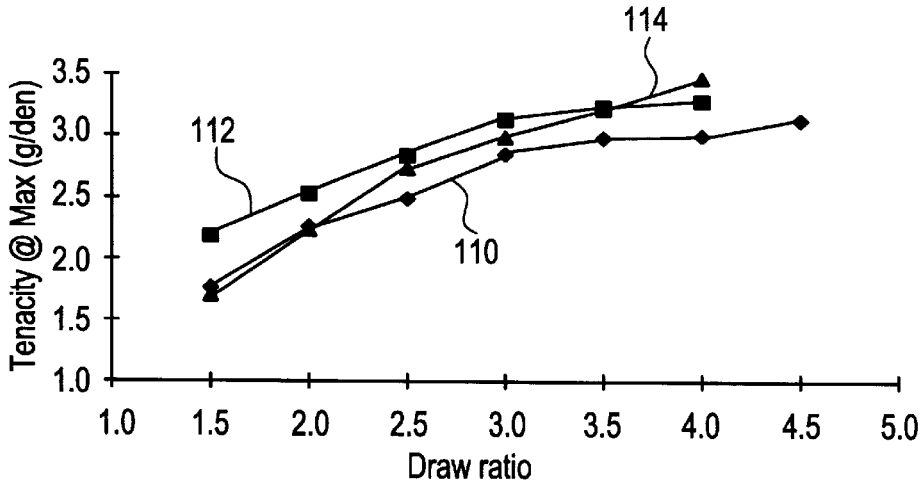
FIG. 3 is a graph of tenacity at maximum elongation on the ordinate versus draw ratio on the abscissa for the three polymers depicted in FIG. 2.
Figure 4:
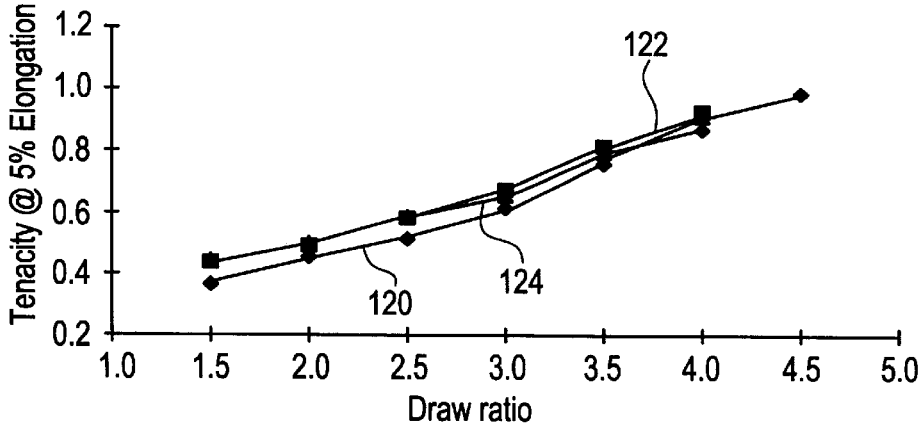
FIG. 4 is a graph of tenacity at 5% elongation on the ordinate versus draw ratio on the abscissa for the three polymers depicted in FIG. 2.
Figure 5:
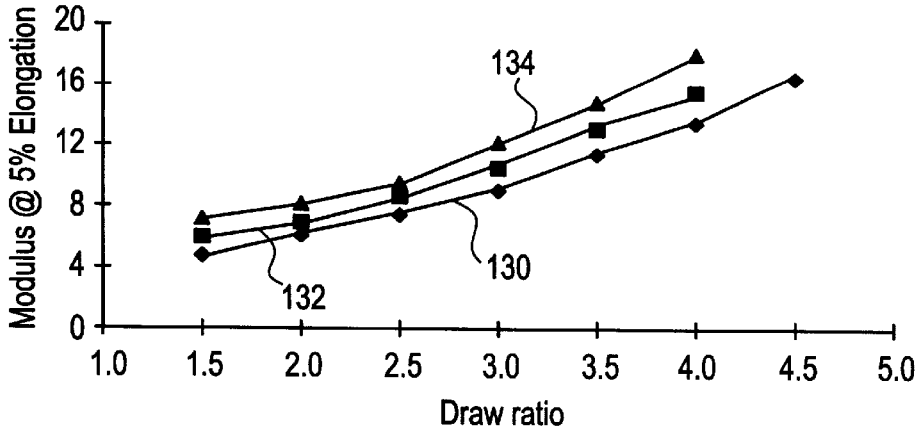
FIG. 5 is a graph of the modulus at 5% elongation on the ordinate versus draw ratio on the abscissa for the three polymers depicted in FIG. 2.

The set of fibers produced from each sample was tested for its physical properties on an Instron Tensile Testing Machine. FIGS. 2–6 reflect the results of various physical tests performed on the 10 dpf fibers. In each of FIGS. 2–6, the measured parameter as described below is plotted on the ordinate versus the draw ratio under which the fibers were oriented which is plotted on the abscissa. In FIG. 2, curve 100 illustrates the relationship for MIPP 1 between elongation at break, measured in percent, and draw ratio. Also in FIG. 2, curve 102 illustrates the relationship for MIPP 2 between elongation at break, measured in percent, and draw ratio. Also in FIG. 2, curve 104 illustrates the relationship for ZNPP 1 between elongation at break, measured in percent, and draw ratio. In FIG. 3, curve 110 illustrates the relationship for MIPP 1 between tenacity at maximum elongation, measured in grams per denier, and draw ratio. Also in FIG. 3, curve 112 illustrates the relationship for MIPP 2 between tenacity at maximum elongation, measured in grams per denier, and draw ratio. Also in FIG. 3, curve 114 illustrates the relationship for ZNPP 1 between tenacity at maximum elongation, measured in grams per denier, and draw ratio. In FIG. 4, curve 120 illustrates the relationship for MIPP 1 between tenacity at 5% elongation, measured in grams per denier, and draw ratio. Also in FIG. 4, curve 122 illustrates the relationship for MIPP 2 between tenacity at 5% elongation, measured in grams per denier, and draw ratio. Also in FIG. 4, curve 124 illustrates the relationship for ZNPP 1 between tenacity at 5% elongation, measured in grams per denier, and draw ratio. In FIG. 5, curve 130 illustrates the relationship for MIPP 1 between the tensile modulus at 5% elongation, measured in MPa, and draw ratio. Also in FIG. 5, curve 132 illustrates the relationship for MIPP 2 between the tensile modulus at 5% elongation, measured in MPa, and draw ratio. Also in FIG. 5, curve 134 illustrates the relationship for ZNPP 1 between the tensile modulus at 5% elongation, measured in MPa, and draw ratio. While these physical properties compared between the samples are not identical, they show similar curves in similar regions, with the curve for ZNPP 1 most instances bracketed by the different MIPP 1 curves. The elongation for MIPP 1 and ZNPP 1 were slightly higher at lower draw ratios but nearly equal for the three materials with increasing draw ratios. As expected based on the low spin and draw tensions for MIPP 1, its tenacity is lower compared to the other two materials. Although there is no appreciable difference in tenacity at 5% elongation, the tensile modulus at 5% elongation separates the three materials.

Figure 6:
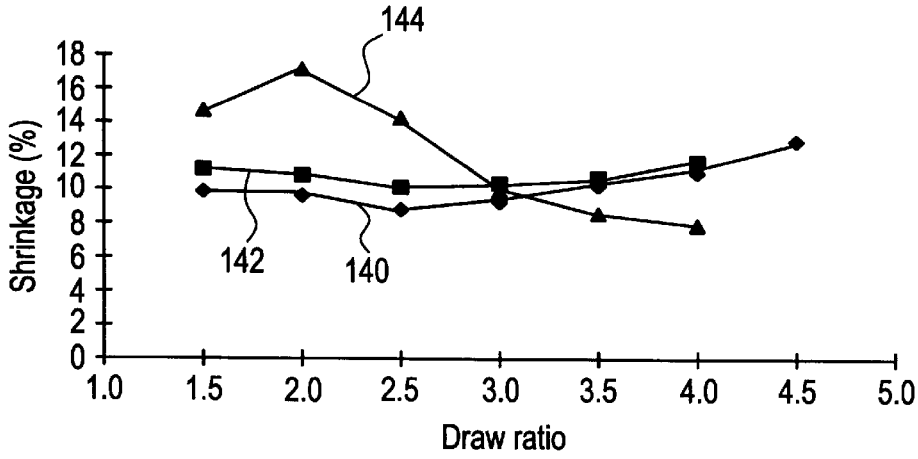
FIG. 6 is a graph of shrinkage on the ordinate versus draw ratio on the abscissa for the three polymers depicted in FIG. 2.

With respect to shrinkage however, a more significant difference shows up. In FIG. 6, curve 140 illustrates the relationship for MIPP 1 between shrinkage, measured in percent, and draw ratio. Also in FIG. 6, curve 142 illustrates the relationship for MIPP 2 between shrinkage, measured in percent, and draw ratio. Also in FIG. 6, curve 144 illustrates the relationship for ZNPP 1 between shrinkage, measured in percent, and draw ratio. While the shrinkage for ZNPP 1 starts relatively high, increase initially and reduces at higher draw ratios, the shrinkage for MIPP 1 and MIPP 2 does not change appreciably with draw ratio. This provides unexpected advantages of reduced shrinkage at lower draw ratios for "low" melt-flow index isotactic polypropylenes.

As indicated by the above data, these results would seem to indicate improved shrinkage properties are observed for metallocent catalyzed isotactic polypropylenes having melt-flow indices within the range of about 5 grams per 10 minutes to about 15 grams per 10 minutes, more preferably within the range of about 8 grams per 10 minutes to about 14 grams per 10 minutes, over the expected shrinkage properties from more traditional Ziegler-Natta catalyzed isotactic polypropylenes. This improvement starts at a draw ratio of about 3 and is fully present at draw ratios less than or equal to about 2.5, and more preferably draw ratios within the range of about 1.5 to about 2.5. The shrinkage percentages at 132° C. are at least about 25% less than the shrinkage percentages at 132° C. for the Ziegler-Natta catalyzed isotactic polypropylene. to about 2.5. The shrinkage percentages at 132° C. are at least about 25% less than the shrinkage percentages at 132° C for the Ziegler-Natta catalyzed isotactic polypropylene.

The work leading up to the results also reveals improved results when the metallocene isotactic polypropylenes are heated in a feeding zone to a temperature within the range of about 190° C. to about 210° C. followed by heating in an extrusion zone to a temperature within the range of about 225° C. to about 235° C. immediately prior to extrusion.

EXAMPLE 2

In the second set of tests, several "medium" melt-flow index homopolymer resins of isotactic polypropylene were used. As with the first set, two of the three resins were isotactic polypropylenes which had been generated by a metallocene catalyst, while the third resin was an isotactic polypropylene generated by a Ziegler-Natta catalyst. The two metallocene-based isotactic polypropylenes (Med MFI MIPP 3 (or "MIPP 3") and Med MFI MIPP 4 (or "MIPP 4")) and the Ziegler-Natta-based isotactic polypropylene (Med MFI ZNPP 2 (or "ZNPP 2")) were used to prepare melt spun yarns on a Fourne fiber spinning machine. Both partially oriented yarn (POY) and fully oriented yarn (FOY) were prepared.

With respect to the polymer resins used, MIPP 3 and MIPP4 were each produced by polymerization of propylene using a metallocene catalyst of the type described previously to produce a narrower molecular weight distribution than MIPP2 and PIPP2. MIPP 3 had a measured melt flow index of 20 grams per 10 minutes with xylene solubles of 0. 49%. MIPP 3 also included the following additives (identified here by the tradenames under which they are commercially available): Irganox 1010 (an anti-oxidant) in an amount of 0. 065 weight percent, Irganox 1076 (an anti-oxidant) in an amount of 0.005 weight percent, Irgafos 168 (an anti-oxidant) in an amount of 0.05 weight percent, and calcium stearate (an acid neutralizer) in an amount of 0.047 weight percent.

MIPP 4 had a measured melt flow index of 19 grams per 10 minutes with a xylene solubles percentage of 0.39%. MIPP 4 included the following additives (identified here by the tradenames under which they are commercially available): Irganox 1076 (an anti-oxidant) in an amount of 0.005 weight percent, Irgafos 168 (an anti-oxidant) in an amount of 0.1 weight percent, Chimasorb 944 (a UV stabilizer) in an amount of 0.038 weight percent, and calcium stearate (an acid neutralizer) in an amount of 0.05 weight percent.

The sample ZNPP 2 was polymerized using a standard supported Ziegler-Natta catalyst, specifically of the type described previously. ZNPP 2 had a measured melt flow index of 22 grams per 10 minutes with xylene solubles of 2.18%. ZNPP 2 included the following additives (identified here by the tradenames under which they are commercially available): Irganox 1076 (an anti-oxidant) in an amount of 0.005 weight percent, Irganox 3114 (an anti-oxidant) in an amount of 0.068 weight percent, Irgafos 168 (an anti-oxidant) in an amount of 0.059 weight percent, Atmos 150 (an anti-static agent) in an amount of 0.029 weight percent, and calcium stearate (an acid neutralizer) in an amount of 0.064 weight percent.

It was generally observed that the metallocene polypropylenes of MIPP 3 and MIPP 4, with their narrow molecular weight distribution, have lower melting points than Ziegler-Natta polypropylenes of comparable melt flow index. Table 4 below shows that ZNPP 2, the Ziegler-Natta polypropylene, had a melting point of 162° C. which is at least 100 more than that of the MIPP 1 and MIPP 2 metallocene polymers which were both at 152° C. The metallocene isotactic polypropylene materials had a lower heat absorb for melting (endothermic) and a lower heat evolved during heat recrystallization (exothermic) demonstrating that they have a lower crystalline content than the Ziegler-Natta polypropylene ZNPP 2.

TABLE 4

| | Med MFI MIPP 3 | Med MFI MIPP 4 | Med MFI ZNPP 2 |
|---|---|---|---|
| DSC 2nd Melt (° C.) | 152 | 152 | 162 |
| dH, 2nd Melt (J/g) | 91 | 92 | 100 |
| DSC, Recryst (° C.) | 109 | 106 | 112 |
| dH, Recryst (J/g) | −89 | −91 | −101 |

Table 5 shows the gel permeation chromatography results for the two MIPP's. Comparative results for ZNPP 2 are not shown.

TABLE 5

| | Med MFI MIPP 3 | Med MFI MIPP 4 | Med MFI ZNPP 2 |
|---|---|---|---|
| $M_n$ (g/mol) | 57,000 | 79,000 | — |
| $M_w$ (g/mol) | 230,000 | 233,000 | — |
| PDI | 4.0 | 2.9 | — |
| $M_z$ (g/mol) | 534,000 | 495,000 | — |

The actual processing of fully and partially oriented yarns from the base resins was accomplished on a Fourne fiber line as addressed above. The processing details are shown in Table 6 below. The two metallocene catalyzed resins were processed at a melt temperatures of 220° C. and 210° C., respectively, with the Ziegler-Natta catalyzed resin processed at 220° C. Pellet feeding problems were again observed in the extruder for the two MIPP resins. Raising the temperature of the feeding zone to 220° C. alleviated the feeding problem. The spinnabilities of the two MIPP resins were lower than ZNPP 2, but the maximum draw ratios were slightly higher. Also, the spin and draw tensions for MIPP 3 and MIPP 4 were lower during the spinning process.

TABLE 6

| | Med MFI MIPP 3 | MED MFI MIPP 4 | MED MFI ZNPP 2 |
|---|---|---|---|
| MFI (g/10 min) | 20 | 19 | 22 |
| Melt Temperature (° C.) | 220 | 210 | 220 |
| Extruder Motor Load (Amp) | 8 | 9.5 | 7.5 |
| Extruder/Spin Pump speed to spin 2400 denier (rpm) | 94/32 | 94/32 | —/32 |
| Spinnability @ 2 dpf (m/min) | 2600 | 3000 | 3500 |
| Spin Tension @ 3:1 draw and G2 = 1000 m/min (gf) | 47 | 41 | 55 |
| Draw Tension @ 3:1 draw and G2 = 1000 m/min (gf) | 1400 | 1200 | 2100 |
| Drawability @ G2 = 1000 m/min | 4.5 | 4.5 | 4.0 |

Figure 7:
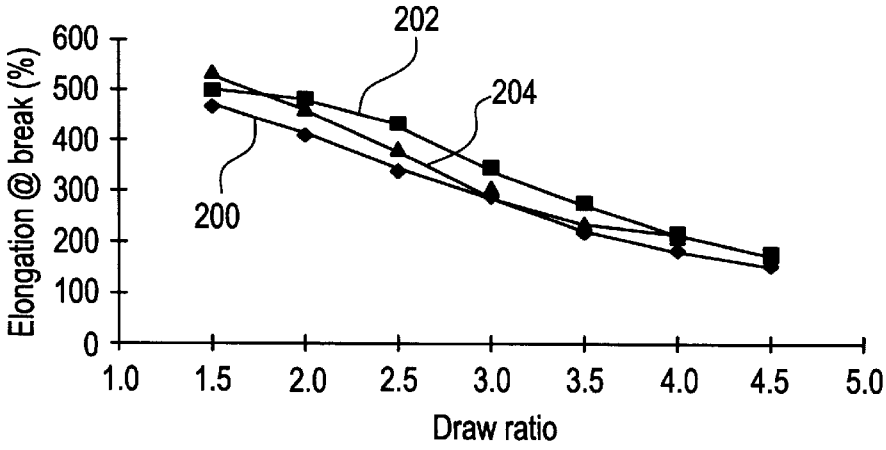
FIG. 7 is a graph of elongation on the ordinate versus draw ratio on the abscissa for medium melt flow index polypropylene prepared by catalysis with metallocene catalyst and a Ziegler-Natta catalyst.
Figure 8:
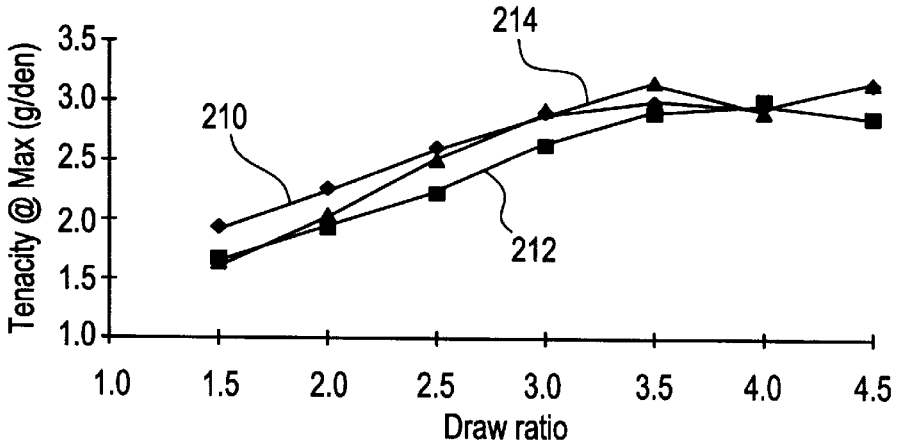
FIG. 8 is a graph of tenacity at maximum elongation on the ordinate versus draw ratio on the abscissa for the three polymers depicted in FIG. 7.
Figure 9:
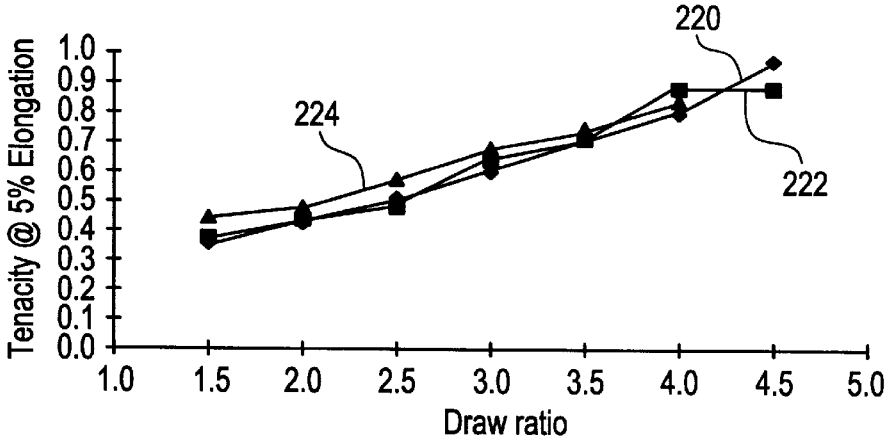
FIG. 9 is a graph of tenacity at 5% elongation on the ordinate versus draw ratio on the abscissa for the three polymers depicted in FIG. 7.
Figure 10:
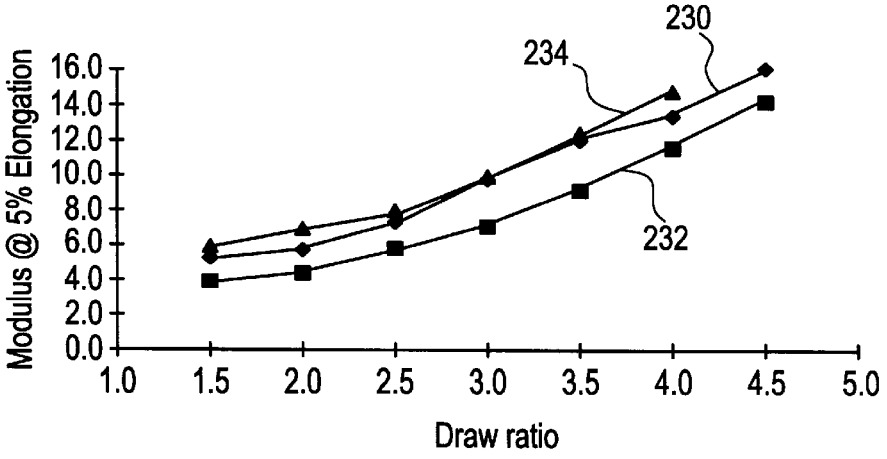
FIG. 10 is a graph of the modulus at 5% elongation on the ordinate versus draw ratio on the abscissa for the three polymers depicted in FIG. 7.

The set of fibers produced from each sample was tested for its physical properties on an Instron Tensile Testing Machine. FIGS. 7–11 reflect the results of various physical tests performed on the 10 dpf fibers. In each of FIGS. 7–11, the measured parameter as described below is plotted on the ordinate versus the draw ratio under which the fibers were oriented which is plotted on the abscissa. In FIG. 7, curve 200 illustrates the relationship for MIPP 3 between elongation at break, measured in percent, and draw ratio. Also in FIG. 7, curve 202 illustrates the relationship for MIPP 4 between elongation at break, measured in percent, and draw ratio. Also in FIG. 7, curve 204 illustrates the relationship for ZNPP 2 between elongation at break, measured in percent, and draw ratio. In FIG. 8, curve 210 illustrates the relationship for MIPP 3 between tenacity at maximum elongation, measured in grams per denier, and draw ratio. Also in FIG. 8, curve 212 illustrates the relationship for MIPP 4 between tenacity at maximum elongation, measured in grams per denier, and draw ratio. Also in FIG. 8, curve 214 illustrates the relationship for ZNPP 2 between tenacity at maximum elongation, measured in grams per denier, and draw ratio. In FIG. 9, curve 220 illustrates the relationship for MIPP 3 between tenacity at 5% elongation, measured in grams per denier, and draw ratio. Also in FIG. 9, curve 222 illustrates the relationship for MIPP 4 between tenacity at 5% elongation, measured in grams per denier, and draw ratio. Also in FIG. 9, curve 224 illustrates the relationship for ZNPP 2 between tenacity at 5% elongation, measured in grans per denier, and draw ratio. In FIG. 10, curve 230 illustrates the relationship for MIPP 3 between the tensile modulus at 5% elongation, measured in MPa, and draw ratio. Also in FIG. 10, curve 232 illustrates the relationship for MIPP 4 between the tensile modulus at 5% elongation, measured in MPa, and draw ratio. Also in FIG. 10, curve 234 illustrates the relationship for ZNPP 2 between the tensile modulus at 5% elongation, measured in MPa, and draw ratio. While these physical properties compared between the samples are not identical, they show similar curves in similar regions, with the curve for ZNPP 2 in most instances near to or bracketed by the different MIPP curves. The elongation for MIPP 4 is slightly higher at middle draw ratios than MIPP 3 and ZNPP 2. Somewhat surprisingly, MIPP 3, which showed lower draw tensions, did not have a drop in tenacity with draw ratio. There was no real difference in tenacity values among the three resins at low extensions. The tensile modulus values at 5% extension for MIPP 3 and ZNPP 2 were higher than that for MIPP 4.

Figure 11:
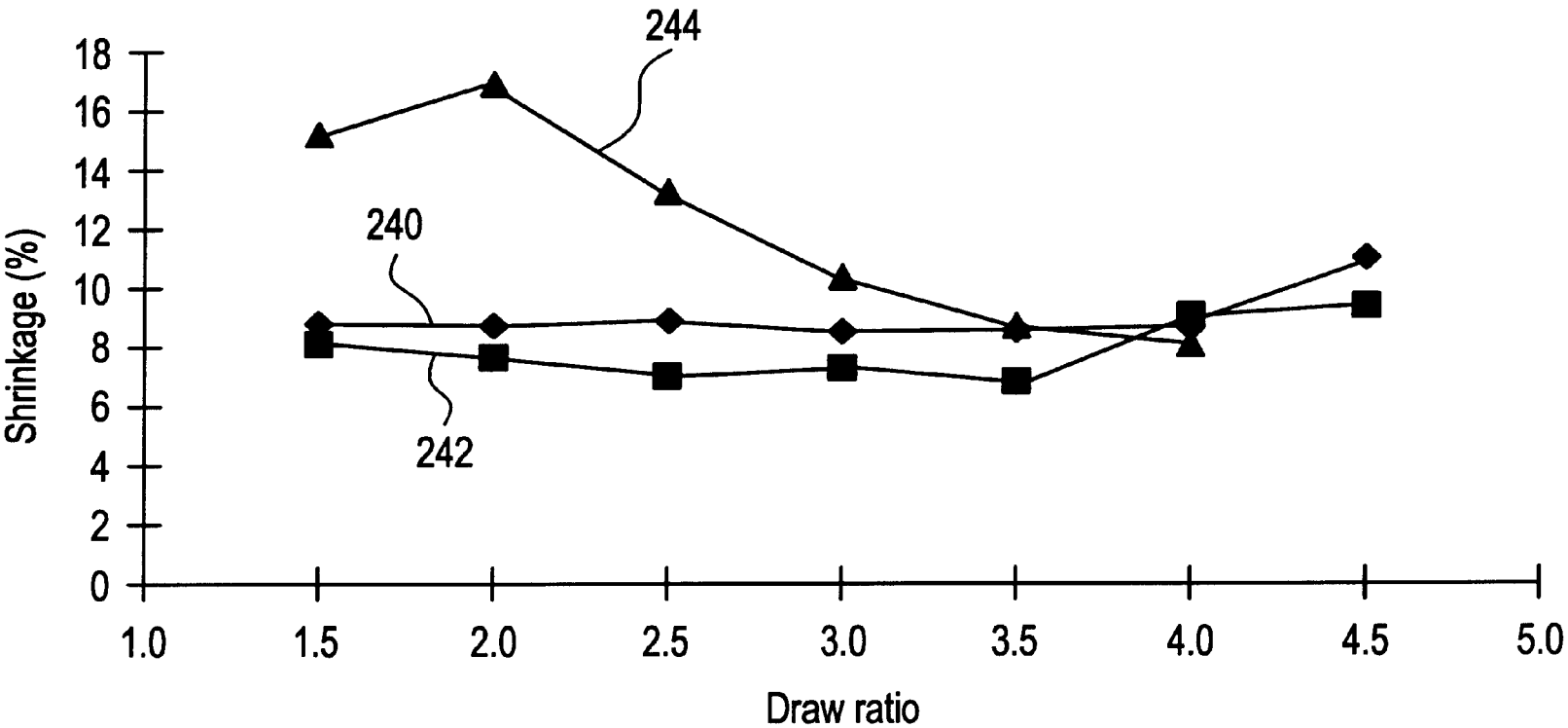
FIG. 11 is a graph of shrinkage on the ordinate versus draw ratio on the abscissa for the three polymers depicted in FIG. 7.

With respect to shrinkage however, the same unexpected trend shows up. In FIG. 11, curve 240 illustrates the relationship for MIPP 3 between shrinkage, measured in percent, and draw ratio. Also in FIG. 11, curve 242 illustrates the relationship for MIPP 4 between shrinkage, measured in percent, and draw ratio. Also in FIG. 11, curve 244 illustrates the relationship for ZNPP 2 between shrinkage, measured in percent, and draw ratio. The shrinkage for ZNPP 2 again starts relatively high, increases initially and reduces at higher draw ratios. The shrinkage values for MIPP 3 and MIPP 4 did not change appreciably with draw ratio. This provides unexpected advantages of reduced shrinkage at lower draw ratios for "medium" melt flow index isotactic polypropylenes as well.

These results indicate improved shrinkage properties for metallocene catalyzed isotactic polypropylenes having melt-flow indices within the range of about 15 grams per 10 minutes to about 25 grams per 10 minutes, more preferably within the range of about 18 grams per 10 minutes to about 21 grams per 10 minutes, over the expected shrinkage properties from more traditional Ziegler-Natta catalyzed isotactic polypropylenes. This improvement starts at a draw ratio of about 3.5 and is becoming fully present at draw ratios less than or equal to about 3.0, and more preferably draw ratios within the range of about 1.5 to about 2.5. The shrinkage percentages at 132° C. are at least about 10% less than the stage percentages at 132° C. for the Ziegler-Natta catalyzed isotactic polypropylene at draw ratios below about 3.0 and at least about 25% less at draw ratios within the range of about 1.5 to about 2.5.

The work leading up to the results also revealed improved results when the metallocene isotactic polypropylenes are heated in a feeding zone to a temperature within the range of about 215° C. to about 225° C. followed by heating in an extrusion zone to a temperature within the range of about 205° C. to about 225° C. immediately prior to extrusion.

However, in tests for "higher" melt-flow index isotactic polypropylenes (about 30 grams per 10 minutes melt-flow index and higher), there was not consistent evidence of this difference between metallocene catalyzed isotactic polypropylene and the more traditional Ziegler-Natta catalyzed isotactic polypropylene.

A further embodiment of the present invention involves the operation of a fiber production line in which changes in the isotactic propylene polymer feed may be made between a Ziegler-Natta isotactic polypropylene and a metallocene isotactic polypropylene. For example, in order to meet design parameters for a specific product, the line may be operated employing an isotactic propylene polymer produced by propylene polymerization in the presence of a conventional Ziegler-Natta catalyst of the type disclosed, for example, in the aforementioned patent to Myer et al. The specific example of such a Ziegler-Natta-based polypropylene would be propylene produced by the homopolymerization of propylene in the presence of a Ziegler-Natta catalyst specifically a titanium tetrachloride catalyst supported on magnesium dichloride. When it is desired to take advantage of a different product parameter produced by a metallocene-based isotactic polypropylene in accordance with the present invention, the propylene polymer product supplied to the preheating and extruding step is switched to a metallocene-based polymer produced by the homopolymerization of propylene in the presence of a metallocene catalyst, preferably a silicon-bridged metallocene catalyst with zirconium as the transition metal.

A preferred method implementing this embodiment would produce polypropylene fibers using first Ziegler-Natta catalyzed polypropylene followed by the use of metallocene catalyzed polypropylene. Initially the system would be provided with a polypropylene polymer with a melt flow index no more than about 25 grams per 10 minutes, comprising isotactic polypropylene produced by the polymerization of polypropylene in the presence of an isospecific Ziegler-Natta catalyst. This would be followed by heating the polypropylene polymer to a molten state and extruding said molten polymer to form a first fiber preform. The first fiber preform would be spun at a take-away speed of at least about 333 meters per minute and subsequently drawn at a drawing speed of at least about 500 meters per minute with the two speeds selected to provide a draw ratio of no more than about 3. This would produce a first continuous polypropylene fiber having a defined percentage shrinkage at 132° C. If an improved shrinkage percentage was then desired, the process could move forward by continuing to provide a polypropylene polymer with a melt flow index no more than about 25 grams per 10 minutes, but in this case use a polymer produced by the polymerization of polypropylene in the presence of an isospecific metallocene catalyst. This polymer would also be heated to a molten state and extruded to form a second fiber preform. The second fiber preform would be spun at a take-away speed of at least about 333 meters per minute and subsequently drawn at a drawing speed of at least about 500 meters per minute with the two speeds selected to provide a draw ratio within the range of about 1.5 to about 3 to produce a second continuous polypropylene fiber. It would be desirable for this fiber (the metallocene catalyzed fiber) to have a shrinkage percentage at 132° C. which is at least about 25% less than the defined shrinkage percentage of the first (Ziegler-Natta catalyzed) continuous polypropylene fiber as evidenced in the examples herein. In some circumstances, particularly where higher draw ratios may be desired, the shrinkage percentage of the second (metallocene catalyzed) continuous polypropylene fiber would desirably be at least about 10% less than the defined shrinkage percentage of the first (Ziegler-Natta catalyzed) continuous polypropylene fiber.

In summary, improved shrinkage properties in spun and drawn fibers may be obtained in metallocene catalyzed isotactic polypropylenes, where the melt-flow indices are no more than about grams per 10 minutes, and where the draw ratios are no more than about 3. For some fiber forming applications the take-away speed is preferably at least about 333 meters per minutes and the drawing speed no more than about 1,000 meters per minute. Alternatively, for some higher speed commercial processes the take-away speed is preferably at least about 1,000 meters per minutes and the drawing speed is preferably no more than about 3,000 meters per minute.

In either event, while certainly not necessary elements, additional preferable features of the process include increasing the temperature in the feeding zone (the early portion of the extruder immediately following insertion through the hopper in the example discussed above) above that which is normally expected. Preferably the metallocene catalyzed isotactic polypropylene is heated in the feeding zone to a temperature within the range of about 180° C. to about 225° C. followed by heating in the extrusion zone to a temperature within the range of about 215° C. to about 240° C. immediately prior to extrusion of the isotactic polypropylene polymer.

Having described specific embodiments of the present invention, it will be understood that modifications thereof may be suggested to those skilled in the art, and it is intended to cover all such modifications as fall within the scope of the appended claims.

What is claimed:

1. A method for the production of polypropylene fibers, comprising a) providing a polypropylene polymer with a melt flow index of no more than about 25 grams per 10 minutes, comprising isotactic polypropylene produced by the polymerization of propylene in the presence of an isospecific metallocene catalyst;

b) heating said polypropylene polymer to a molten state and extruding said molten polymer to form a fiber preform; and c) spinning said fiber preform and subsequently drawing said preform at a take-away speed and a drawing speed providing a draw ratio of no more than about 3 to produce a continuous polypropylene fiber.

2. The method of claim I wherein said fiber is formed with a take-away speed and a drawing speed providing a draw ratio of no more than about 2.5.

3. The method of claim 1 wherein said fiber is formed at a take-away speed of at least about 333 meters per minutes and a draw speed of no more than about 1,000 meters per minute providing a draw ratio of no more than about 3.

4. The method of claim 1 wherein said fiber is formed at a take-away speed of at least about 1,000 meters per minutes and a draw speed of no more than about 3,000 meters per minute providing a draw ratio of no more than about 3.

5. The method of claim 1 wherein said polyprpylene polymer has a melt flow index within the range of about 15 grams per 10 minutes to about 25 grams per 10 minutes.

6. The method of claim 1 wherein said polypropylene polymer has a melt flow index within the range of about 18 grams per 10 minutes to about 21 grams per 10 minutes.

7. The method of claim 1 wherein said polypropylene polymer has a melt flow index within the range of about 5 grams per 10 minutes to about 15 grams per 10 minutes.

8. The method of claim 1 wherein said popylene polymer has a melt flow index within the range of about 8 grams per 10 minutes to about 14 grams per 10 minutes.

9. The method of claim 1 wherein said polypropylene polymer is heated in a feeding zone to a temperature within the range of about 180° C. to about 225° C. followed by heating in an extrusion zone to a temperature within the range of about 215° C. to about 240° C. immediately prior to said extruding said polypropylene polymer.

10. The method of claim 5 wherein said polypropylene polymer is heated in a feeding zone to a temperature within the range of about 215° C. to about 225° C. followed by heating in an extrusion zone to a temperature within the range of about 205° C. to about 225° C. immediately prior said extruding said polypropylene polymer.

11. The method of claim 7 wherein said polypropylene polymer is heated in a feeding zone to a temperature within the range of about 190° C. to about 210° C. followed by heating in an extrusion zone to a temperature within the range of about 225° C. to about 235° C. immediately prior to said extruding said polypropylene polymer.

12. The method of claim 1 wherein said isospecific metallocene catalyst is characterized by a bridged bis (indenyl) ligand in which the indenyl ligand is enantiomorphic and is selected from the group consisting of unsubstituted indenyl ligands and substituted indenyl ligands.

13. The method of claim 1 wherein said isospecific metallocene catalyst is characterized by the formula rac-R'R"Si(2-RiInd)MeQz wherein, R', R" are each independently a $C_1$–$C_4$ alkyl group or an phenyl group, Ind is an indenyl group or a hydrogenated indenyl substituted at the proximal position by the substituent $R_i$ and being otherwise unsubstituted or substituted at one or two of the 4, 5, 6, and 7 positions, Ri is an ethyl, methyl, isopropyl, or tertiary butyl group, Me is a transition metal selected from the group consisting of titanium, zirconium, hafnium, and vanadium, and each Q is independently a hydrocarbyl group containing 1 to 4 carbon atoms or a halogen.

14. A method for the production of polypropylene fibers, comprising a. providing a polypropylene polymer with a melt flow index no more than about 25 grams per 10 minutes, comprising isotactic polypropylene produced by the polymerization of polypropylene in the presence of an isospecific Ziegler-Natta catalyst;

b. heating said polypropylene polymer to a molten state and extruding said molten polymer to form a first fiber preform;

c. spinning said first fiber preform at a take-away speed of at least about 333 meters per minute and subsequently drawing said preform at a drawing speed of at least about 500 meters per minute to provide a draw ratio of no more than about 3 to produce a first continuous polypropylene fiber having a defined percentage shrinkage at 132° C.;

d. continuing to provide a polypropylene polymer with a melt flow index no more than about 25 grams per 10 minutes, produced by the polymerization of polypropylene in the presence of an isospecific metallocene catalyst and heating said continuously provided polymer to a molten state and extruding said molten polymer to form a second fiber preform; and e. spinning said second fiber preform at a take-away speed of at least about 333 meters per minute and subsequently drawing said second fiber preform at a drawing speed of at least about 500 meters per minute to provide a draw ratio within the range of about 1.5 to about 3 to produce a second continuous polypropylene fiber having a shrinkage percentage at 132° C. which is at least about 25% less than said defined shrinkage percentage of said first continuous polypropylene fiber.

15. The method of claim 14 wherein the shrinkage percentage of said second continuous polypropylene fiber is at least about 10% less than said defined shrinkage percentage of said first continuous polypropylene fiber.

* * * * *